US006705791B2

(12) United States Patent
Harper

(10) Patent No.: US 6,705,791 B2
(45) **Date of Patent: *Mar. 16, 2004**

(54) RESIN APPLICATION

(76) Inventor: Alan Roger Harper, Plastech Thermoset Tectonics, Unit 1, Delaware Road, Gunnislake, Cornwall PL18 9AR. (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 10/202,251

(22) Filed: Jul. 23, 2002

(65) Prior Publication Data

US 2003/0021623 A1 Jan. 30, 2003

(30) Foreign Application Priority Data

Jul. 27, 2001 (GB) ..... 0118296

(51) Int. Cl.[7] ..... B43M 11/02
(52) U.S. Cl. ..... 401/219; 401/208

(58) Field of Search ..... 401/219, 220, 401/208, 188 R; 417/14, 18, 305, 306, 307

(56) References Cited

U.S. PATENT DOCUMENTS

| | | | | | |
|---|---|---|---|---|---|
| 2,536,291 | A | * | 1/1951 | Kaitul | 401/219 |
| 2,654,107 | A | * | 10/1953 | Magoon | 401/219 |
| 2,827,649 | A | * | 3/1958 | Perry | 401/219 |
| 2,898,618 | A | * | 8/1959 | Whitfield et al. | 401/219 |
| 3,827,827 | A | * | 8/1974 | Hill | 417/28 |
| 4,302,122 | A | * | 11/1981 | Moya | 401/268 |
| 4,540,301 | A | * | 9/1985 | Swanson et al. | 401/146 |

* cited by examiner

*Primary Examiner*—David J. Walczak
(74) *Attorney, Agent, or Firm*—Melvin I. Stoltz

(57) ABSTRACT

A resin applicator comprises a roller mounted on a shank connected to a handgrip, and a hose for feeding the resin to the roller under the action of a prime mover. A normally open air bleed switch is positioned so that it is accessible to a thumb or finger of a hand holding the handgrip and is operable to control operation of the prime mover.

6 Claims, 1 Drawing Sheet

RESIN APPLICATION

FIELD OF THE INVENTION

This invention relates to a method and means of resin application and has been developed in relation to the fibre-reinforced plastics industry.

In open moulding within the fibre-reinforced plastics industry, the majority of moulders apply resin to the mould to enable the dry glass mat to be wetted out using one or more of the following three methods:—

1.a bucket and brush, 2. a bucket and roller/brush combination, and 3. a resin spray machine (sometimes in combination with the reinforcement as a flow of chopped fibre strands within the resin spray stream).

The second method is sometimes mechanised by delivering catalysed resin to the roller to speed the manual application. This obviously allows the operator to continue roller saturation of the mat in the open mould without stopping to pre-saturate the roller. This second method is thus carried out in a similar way to applying paint to walls with a roller and roller tray for the paint.

The industry has had a mixed response to roller saturators as they can be more cumbersome to use than a standard roller as they have a feed hose attached to them and some form of control valve. Consequently most systems are offered attached to a roller extension pole on which the control valve can be mounted more readily and the additional weight is less obvious as use of the pole is a two-handed operation.

The systems currently available have bespoke rollers and resin delivery spray bars and, in some instances, internal resin feed to the roller. Their cost reflects this. Because of this, not many fibre-reinforced plastic moulders utilise roller saturators.

Existing roller saturator machines use meter mix machines which work at high pressure to deliver the requisite resin and hardener to a mix chamber prior to use. This is because they utilise existing spray machine systems and simply replace the spray head with a roller head. However, spray systems need to work at a higher pressure, circa 10–50 bar, in conjunction with fluid accumulators to even out the small fluctuations resulting from the use of double-acting reciprocating pumps. If not, the spray pattern would increase and decrease with each change in direction of the pump stoke.

In all the above systems, the resin mixture flow is started and stopped by simply opening and closing fluid valve/s at or near the mixing head. The pumps simply stall when the valves are closed and begin motion feed when the valves are opened.

It is accordingly an object of the present invention to provide an improved method of dispensing a resin.

It is a further object of the present invention to provide an improved means for dispensing a resin.

SUMMARY OF THE INVENTION

According to a first aspect of the present invention there is provided a method of dispensing a resin which comprises the use of a roller mounted on a shank connected to a handgrip, feeding the resin to the roller by means of a prime mover, holding the handgrip and controlling operation of the prime mover by means of a normally open air bleed switch accessible to a thumb or finger of a hand holding the handgrip.

According to a second aspect of the present invention there is provided means for dispensing a resin comprising a roller mounted on a shank connected to a handgrip, means for feeding the resin to the roller under the action of a prime mover, and a normally open air bleed switch accessible to a thumb or finger of a hand holding the handgrip and operable to control operation of the prime mover.

The means for feeding the resin to the roller preferably comprises a hose which is attached to the roller shank adjacent the handgrip (and may be arranged to pass through the handgrip).

The air bleed switch preferably comprises a spring steel lever which carries a pad or disc which can be moved, by manual deformation of the spring steel lever, into a position in which it closes an opening of an air bleed nipple, the pad or disc returning under the resilient action of the spring steel lever into a position spaced from the opening when the manual pressure is released.

The roller is preferably a standard roller and the cost of adapting the roller to provide for the dispensing of the resin will be substantially less than the cost of the roller saturators referred to above.

DESCRIPTION OF THE PREFERRED EMBODIMENT

Figure 1:
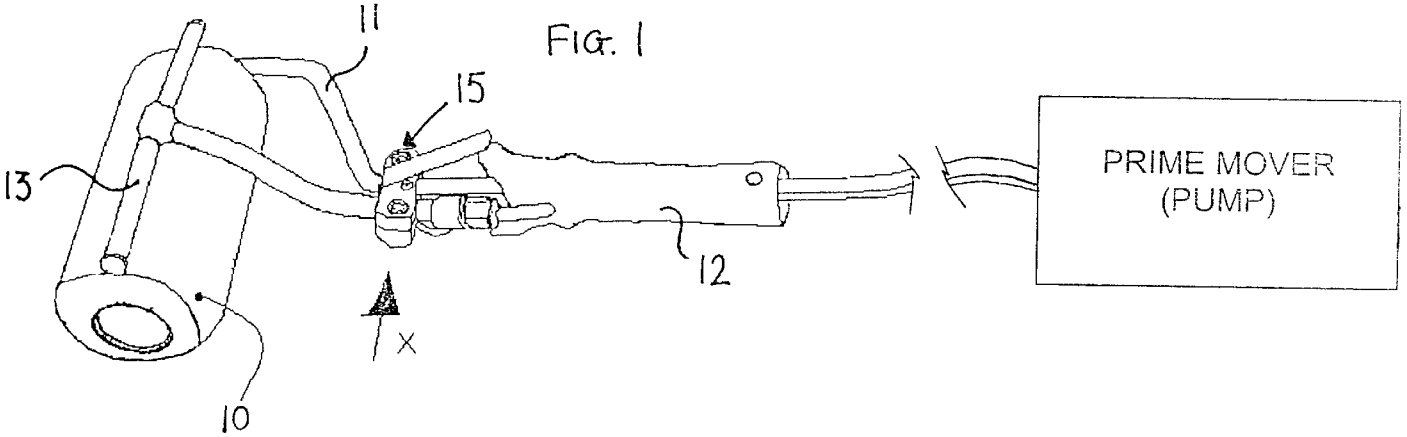
FIG. 1 is a perspective view of a resin applicator.
Figure 3:
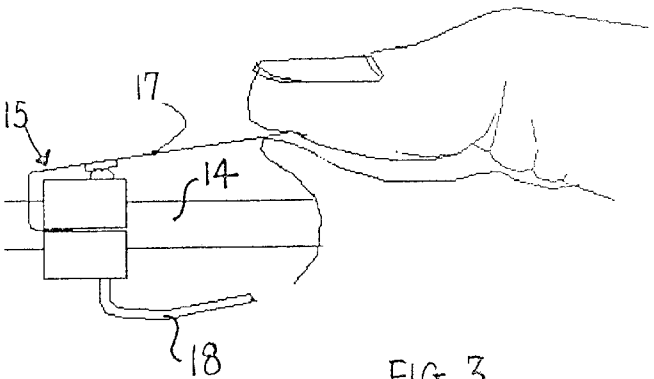
FIG. 3 is a detail view corresponding to FIG. 2 but showing the air bleed switch in its closed position.
Figure 2:
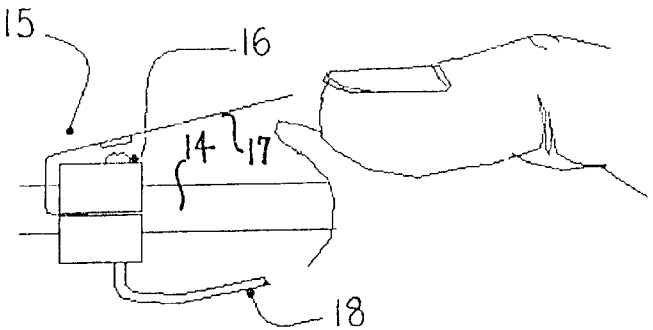
FIG. 2 is a detail view of part of the resin applicator showing the air bleed switch in its open position.

The resin application system shown in the drawings comprises a roller 10 which is mounted on a shank 11 connected to a hollow handgrip 12. Resin is supplied to a spreader bar 13, which extends parallel to the axis of rotation of the roller 10, by means of a hose 14 connected to a mixing head and pumps (not shown) operated by a main air motor.

The main air motor is stopped and started by means of a pilot-operated air valve. There is thus no need of fluid valve control to start and stop the resin mix feed. Instead, the operator is provided with a simple and safe start/stop air bleed switch 15. This is placed in direct proximity to the operator's hand on the roller handgrip 12.

The air bleed switch 15 utilises a small constant flow of air pressure at about 2 bar bleeding from a small hole in an air bleed nipple 16. When this hole is covered by the operator's finger or by a pad carried by a spring steel lever 17, back pressure builds instantly in the bleed line 18 and is sensed by a pneumatic valve amplifier which turns the small back pressure bleed signal into a full pressure signal to the pump air motor valve to start. The reverse takes place to stop the pump. The control of the flow of the resin can thus be achieved by the operator using a thumb or finger of the hand holding the handgrip 12.

It will be appreciated that the use of such a switch within the environment of a sticky resin dispensing system is much better than a traditional mechanical pneumatic switch. With the arrangement shown in the drawings, air is being bled all the time that no resin is being demanded and the pump remains stopped. This small air stream prevents resin from blocking the air switch hole which, if it did become blocked, would inadvertently give a start signal.

Another advantage of the use of the pneumatic bleed switch 15 for this application is that it allows the entire roller, handle and switch to be immersed in cleaning solvents after production without any harm being done to the switch as the air bleed keeps the solvent out of the system.

Such a switch has virtually no weight and is not a fire risk. It is thus the ideal type to use for such an applications.

Wet out rates of 10 sec/$m^2$ of laminate are readily achieved using a roller system as described above. It is also to be noted that the fine control which can be obtained also allows laminates of relatively moderate size to be saturated economically with resin.

The system can be fed from the pump mixing chamber with relatively low pressure, typically below 8 bar and as low as 2 bar with normal laminating resin mix. This allows the system to work with low cost un-reinforced, light-weight, flexible and bendable resin feed hose. This is both an economic advantage and an operator use advantage as the feed line to the roller is very compliant and light, ensuring greater user acceptance of the system as compared with previous traditional systems.

What is claimed is:

1. A method of dispensing a resin which comprises the use of a roller mounted on a shank connected to a handgrip, feeding the resin to the roller by means of a prime mover, holding the handgrip and controlling operation of the prime mover by means of a normally open air bleed switch accessible to a thumb or finger of a hand holding the handgrip.

2. Means for dispensing a resin comprising a roller mounted on a shank connected to a handgrip, means for feeding the resin to the roller under the action of a prime mover, and a normally open air bleed switch accessible to a thumb or finger of a hand holding the handgrip and operable to control operation of the prime mover.

3. Dispensing means as claimed in claim 2, in which the means for feeding the resin to the roller comprises a hose which is attached to the roller shank adjacent the handgrip.

4. Dispensing means as claimed in claim 3, in which the hose is arranged to pass through the handgrip.

5. Dispensing means as claimed in claim 2, in which the air bleed switch comprises a spring steel lever which carries a pad or disc which can be moved, by manual deformation of the spring steel lever, into a position in which it closes an opening of an air bleed nipple.

6. Dispensing means as claimed in claim 5, in which the pad or disc is arranged to return under the resilient action of the spring steel lever into a position spaced from the opening when the manual pressure is released.

* * * * *